US006299170B1

(12) United States Patent
Yoseloff

(10) Patent No.: US 6,299,170 B1
(45) Date of Patent: Oct. 9, 2001

(54) HIGHER FREQUENCY WILD CARD GAME AND APPARATUS

(76) Inventor: Mark L. Yoseloff, 1900 Grey Eagle St., Henderson, NV (US) 89014

( * ) Notice: Subject to any disclaimer, the term of this patent is extended or adjusted under 35 U.S.C. 154(b) by 0 days.

(21) Appl. No.: 09/304,753

(22) Filed: May 4, 1999

(51) Int. Cl.[7] ..... A63F 1/00

(52) U.S. Cl. ..... 273/292; 273/274; 273/85; 273/309; 463/12; 463/13; 463/20; 463/46

(58) Field of Search ..... 273/292, 85, 309, 273/274; 463/13, 20, 46, 12

(56) References Cited

U.S. PATENT DOCUMENTS

| | | | | |
|---|---|---|---|---|
| 4,743,022 | | 5/1988 | Wood | 273/85 CP |
| 4,813,675 | | 3/1989 | Greenwood . | |
| 4,861,041 | | 8/1989 | Jones et al. . | |
| 5,019,973 | | 5/1991 | Wilcox et al. . | |
| 5,033,744 | | 7/1991 | Bridgemann et al. . | |
| 5,042,818 | | 8/1991 | Weingardt | 273/292 |
| 5,275,411 | | 1/1994 | Breeding . | |
| 5,288,077 | | 2/1994 | Jones . | |
| 5,288,081 | * | 2/1994 | Breeding | 273/292 |
| 5,308,065 | | 5/1994 | Bridgeman et al. | 273/85 CP |
| 5,356,140 | | 10/1994 | Dabrowski et al. | 273/85 CP |
| 5,364,105 | | 11/1994 | Jones . | |
| 5,377,973 | | 1/1995 | Jones et al. . | |
| 5,437,462 | * | 8/1995 | Breeding | 273/292 |
| 5,452,899 | | 9/1995 | Skratulia et al. . | |
| 5,529,309 | | 6/1996 | Bartlett . | |
| 5,531,440 | | 7/1996 | Dabrowski et al. . | |
| 5,577,731 | | 11/1996 | Jones . | |
| 5,584,485 | | 12/1996 | Jones et al. . | |
| 5,607,162 | | 3/1997 | Boylan et al. . | |
| 5,626,341 | | 5/1997 | Jones et al. . | |
| 5,660,393 | | 8/1997 | Dreger . | |
| 5,669,813 | | 9/1997 | Jairazbhoy et al. . | |
| 5,669,817 | * | 9/1997 | Tarantino | 463/13 |
| 5,775,992 | | 7/1998 | Wood | 463/13 |
| 5,794,964 | | 8/1998 | Jones et al. . | |
| 5,803,809 | | 9/1998 | Yoseloff . | |
| 5,947,821 | | 9/1999 | Stone | 463/13 |
| 6,004,205 | | 12/1999 | Lauretta et al. . | |
| 6,015,347 | * | 1/2000 | Maahs et al. | 463/27 |

* cited by examiner

*Primary Examiner*—Steven Wong
*Assistant Examiner*—Dolores R. Collins
(74) *Attorney, Agent, or Firm*—Mark A. Litman & Assoc. P.A.

(57) ABSTRACT

A method of playing a live casino card game with a video display of a wild card comprises dealing a number of physical playing cards to a player to form an original hand, the player having made a wager on a card game being played with that original hand. From a separate virtual deck of playing cards, dealing at least one card that is a video display card. At any time during play of the game, showing the value of the at least one card that is a video display card, the at least one card that is a video display card establishing a fact that physical cards of a predetermined relationship to the at least one card that is a video display card are Wild Cards for the purpose of establishing a rank or value for the player's hand. The player is then paid for attaining a hand of at least a predetermined rank or having a hand with a value higher than the value of a dealer's hand; the rank or value being determined with or without the presence of Wild Cards.

31 Claims, 4 Drawing Sheets

HIGHER FREQUENCY WILD CARD GAME AND APPARATUS

BACKGROUND OF THE INVENTION

1. Field of the Invention

The present invention relates to a game of chance and skill, specifically to a card game which is particularly suitable for use in casinos and which can be played either as a computer video game or as a table game. In particular, the invention relates to a card game in which a wild card is provided in the play of the game.

2. Background of the Art

Wagering games played in casino establishments have achieved a very high level of public acceptance. Particularly in the United States, there are now thousands of casinos in many different locations, and in certain jurisdictions, private businesses may have video gaming equipment. The rise in gaming has been in large part because of the entertainment value of gaming, the variety of games available to provide interest to the player beyond the gaming aspects of play itself, and greater acceptance of gaming by the public. It is generally recognized that successful games should: (1) be entertaining for the players, (2) attract the attention of and visual interest of players, (3) stimulate rapid numbers of wagers during predetermined time periods; (4) provide reasonable and understandable odds to the player, (5) provide unvarying overall odds in favor of the casino; (6) be sufficiently simple to allow rapid acceptance of the game with a short learning curve, and (7) be easily monitored by observers and any dealer to avoid errors and cheating. Both casino table games and video games have achieved high levels of success with these parameters kept in mind during their design.

There are a wide variety of poker games available to players in private games, club games, casino table games and video gaming equipment. In casino video gaming equipment, the easiest format to work with comprises variants of five-card draw poker. This game is played in a video gaming format with many variations, for example, by having five cards dealt to a player. The player selects his best cards (e.g., the cards most likely to provide a highly ranked hand when the player discards and draws replacement cards), discards unneeded cards, and then draws replacement cards. The objective in these video games is generally to achieve the best possible hand, according to conventional poker hand rankings, with hands of various ranks being awarded payouts that are multiples (usually with limits from about 1:1 to about 4000:1) of the wager. The game has such a readily appreciated ease of understanding and play that the format has been highly successful. Common variants of this game include games where deuces within the playing deck are wild, jokers added to the playing deck are wild, multiple mixed decks are used for the dealing of hands, extra bonuses are provided for unique hands, and the like. These variations in the rules are still readily understood and add variety to the basic pure game of five card draw.

U.S. Pat. No. 4,743,022 to Michael Wood, 1988, discloses a poker game which can be played on a computer video output screen gaming machine or as a table game. At the start of the game, the player makes a first wager and receives five cards, which constitutes a first hand. As is known to those skilled in the art, five-card poker hands are ranked, for competitive purposes, according to the following order from lowest to highest: (1) High Card in Hand; (2) One Pair; (3) Two Pair; (4) Three of a Kind; (5) Straight; (6) Flush; (7) Full House; (8) Four of a Kind; (9) Straight Flush; (10) Royal Flush; (11) Five of a Kind (which is possible only if a joker is used). Then each player may discard up to five cards and receive five new cards to form a second hand. The player loses the first wager if the second hand (or the first hand when no cards are discarded) does not have a pair. The player receives the wager back if the hand has a pair. The player receives a payout which exceeds the first wager in accordance with the posted odds if the hand is of higher order than a pair. The player is also entitled to make a second wager and to receive a sixth card. A five-card third hand having the highest possible ranking is then formed by combining the newly dealt card and any four of the five cards in the second hand. If the third hand is ranked lower than a straight and is of lower order than the second hand, the player loses the second wager. However, if the third hand has a ranking of a straight or greater and is of higher order than the second hand, the player wins an amount which depends on the second wager and the posted odds.

Although the Wood's game allows the player an additional possibility of winning by providing the sixth card, the payout odds must be diminished proportionally, thus decreasing the generated level of excitement. Moreover, the thrill of the game is also reduced because the sixth card rarely produces a dramatic improvement in the ranking of the player's hand. Furthermore, the rules of the game are fairly complex, involving three different hands and sometimes enigmatic criteria for receiving the sixth card (the video-game version). Several wild-card versions of Wood's game have been suitable for casinos. In these, a wild card may possess any value specified by the player. For example, when deuces are wild, they can be counted as kings, aces, or have any other value and can fill in straights or flushes. Other variations of the game exist, for instance with jokers or eights wild. However, when wild cards are used, the game lacks the exciting element of surprise since the wild cards are declared to the player at the start of the game. Moreover, the game is rendered less attractive because the player always retains the wild cards and hence a lower pay table must be utilized. Thus, the player normally wins only when his or her hand ranking is three of a kind or higher.

U.S. Pat. No. 5,308,065 describes a poker game comprising a player making a wager and then being dealt a hand of five cards in a specific card location, with the cards being viewed by the player (e.g., face-up). The player is also dealt a single card from the same deck, this card being dealt face-down. The player may attempt to improve the five card hand by utilizing standard five card draw steps. After the player has acted on the five card hand, the sixth card is turned face-up, and all the cards in the player's hand which have the same face value as the turned card are designated as a wild card. The method of playing the game of chance is described as utilizing a maximum set with a finite plurality of scorable units, each having a fixed value, wherein the scorable units can be assembled, according to predetermined rules, into small sets having different rankings, said method comprising the steps of:

a player placing a wager; the player receiving an original set of A scorable units randomly chosen from the finite plurality of scorable units, where A is an integer, the original set having a ranking known to the player, thereby reducing the maximum set by the number of scorable units in said original sets. The player receives a solitary scorable unit randomly chosen from the finite plurality of scorable units remaining, the solitary scorable unit having a value concealed from the player, thereby reducing the maximum set by one additional unit. The player has a chance to improve the ranking of the original set by discarding up to A scorable units from the original set and replacing them with an equal number of scorable units randomly chosen from the remaining finite plurality of scorable units, thus forming a modified original set. The value of the solitary scorable unit is revealed to said player. All scorable units of the modified original set which have the same value as the solitary scorable unit are assigned replacement arbitrary values which maximally improve the ranking of the modified original set. The modified original set is evaluated in accordance with predefined criteria to determine whether the player has won or lost the wager. Thus the play of the game provides a wild card from within the set of symbols used in the play of the game.

U.S. Pat. No. 5,042,818 describes a multideck poker game that is able to provide unique hands without the use of wild cards. A first hand is dealt from a first deck of cards. The player may select an additional card or cards to be dealt into his playing hand from an additional deck of cards. The player may discard cards, with replacement cards coming from the original decks from which the discards were dealt. In this manner, a hand of six or more cards may be created that has the possibility of poker hands unavailable from a single deck (e.g., a seven card royal flush).

U.S. Pat. No. 5,356,140 describes a video format gaming apparatus where a player makes a wager to participate in the game and the player is dealt two distinct hands at the beginning of the game. Each hand is dealt from its own separate complete deck of cards. The player selects one of the hands to play and the unselected hand is voided or removed from use. The player plays out the selected hand according to the conventional manner of play of the hand.

U.S. Pat. No. 5,803,809 describes a method of playing a card game wherein multiple decks of playing cards are used in a unique format which results in hands being possible that were not previously available. In the play of the game, such as five card draw poker, each card position in a player's hand is dealt from a distinct deck. This enables the possibility of unique hands such as five aces of spades, without the need for using wild cards. In addition to the use of standard decks of cards, this method contemplates the use of decks which have been modified slightly, such as by the addition of two jokers to each deck. Similarly, U.S. Pat. No. 5,775,992 enables the possibility of unique types of hands by shuffling, for example, the same number of decks together as there are cards in a player's hand (e.g., five decks would be shuffled together where the game is five card stud). This allows similar types of hands as U.S. Pat. No. 5,803,809.

These games provide a useful variety of games to be played in various casino or private formats, but there is always a desire for different games with unique playing features to be available.

BRIEF DESCRIPTION OF THE INVENTION

A method of playing a game, including a game of poker comprises:

a) dealing a number of playing cards to a player to form an original hand. The player has made a wager on a game such as a poker game being played with that original hand or places a wager at any time before seeing one or more cards of the hand;

b) from a separate deck of playing cards, dealing one card that is a display card;

c) showing the value of the display card, the display card establishing a fact that cards of equal rank or value to the display card are Wild Cards for the purpose of establishing a rank or value (e.g., total point count) for the player's hand; and d) paying the player for attaining a hand of at least a predetermined rank with or without the presence of Wild Cards or for displaying a hand that wins against a dealer's hand in the play of an underlying game. The game may be played as a live table game, a video game, or other computer format game (e.g., over the Internet). Where the game is a draw poker game, steps such as allowing the player to discard cards from the original hand, and dealing player replacement cards to bring the player's hand up to the number of cards used to play the game of poker may be used.

DETAILED DESCRIPTION OF THE INVENTION

Figure 1:
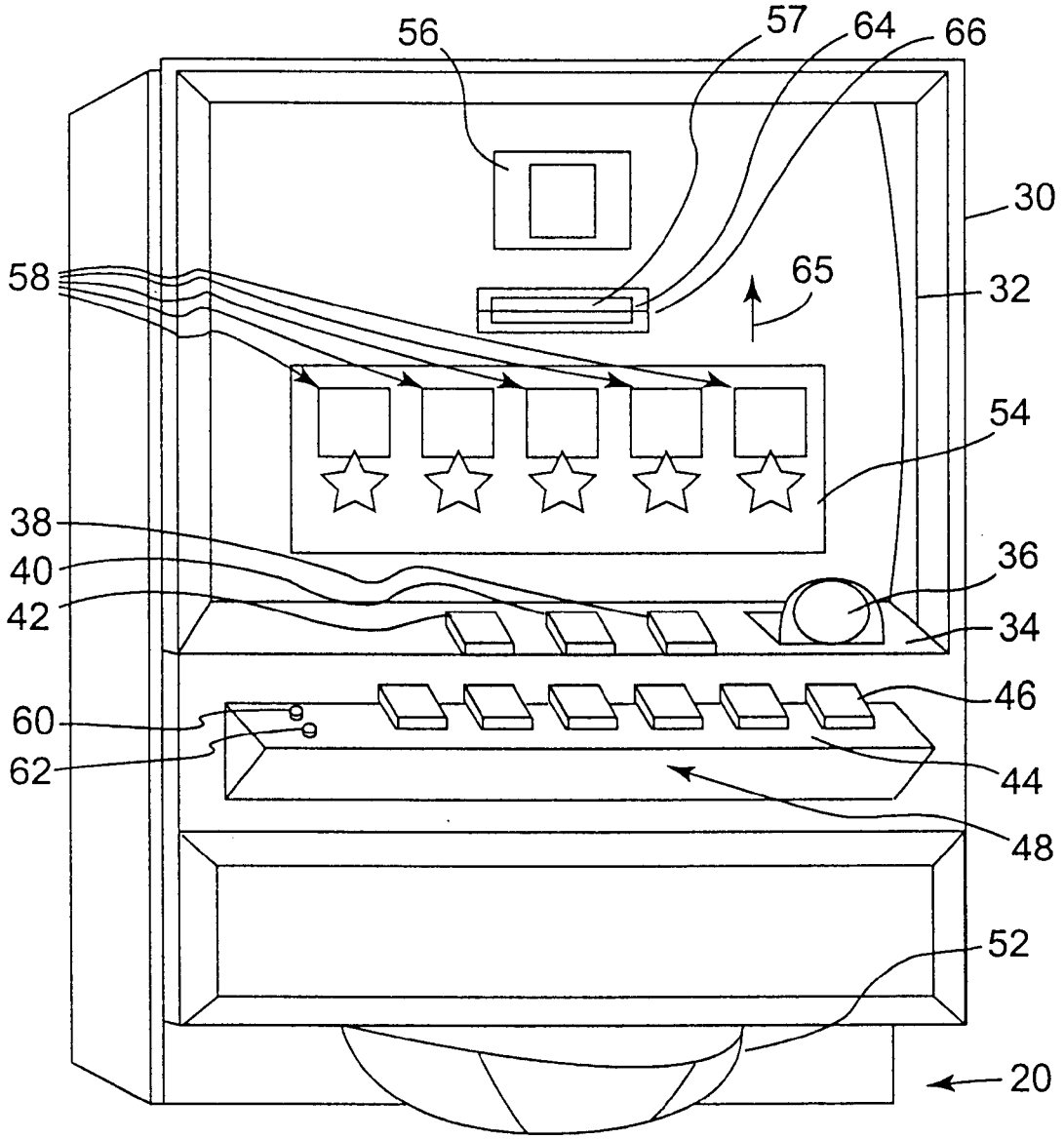
FIG. 1 is a perspective view of a video apparatus designed to be used in the play of the card game of the present invention.

The present invention is a unique method of playing a casino-type card game in either a live action table game or as a video or computer game. According to the present invention, a hand of cards is dealt to a player from a first master set of cards. If the underlying game is conventional draw poker or stud poker, the player receives five cards from a single 52 card deck, which are available for viewing by the player.

According to a preferred method of the present invention, a single card is dealt from a second and separate deck to the player. Either before, during, after or at the conclusion of play of the underlying game, the single card is revealed. The rank, suit, or rank and suit of the revealed card determines which cards in the player's hand are wild. Cards held by the player having a rank, suit, or rank and suit equal to that of the revealed card become wild cards.

The method can be practiced by dealing each player his or her own wild card, or by dealing a common or "community" wild card to multiple players participating in a round of play. Preferably, the wild card does not become part of the player's hand. It preferably serves as an indicator of which cards in the master set of cards are considered wild during that hand.

The method of the present invention can be practiced on a video output wagering device, on a live gaming table, as a personal-computer based game, on a hand-held gaming unit, or on virtually any equipment which includes a CPU (central processing unit) and memory. Although the following disclosure describes the method of the present invention in the context of draw poker, the method can be used to enhance the excitement and entertainment value of nearly any casino card game, such as 5 card stud poker, Blackjack, Pai Gow poker, Let it Ride® Stud Poker, Caribbean Stud® poker, Baccarat, mini Baccarat, and variations of draw poker, including Texas Hold 'Em, Deuces Wild, and Triple Play Poker®.

In a first embodiment, a video output gaming device is programmed to display a preferred draw poker game of the present invention, and is described in detail below. The apparatus may perform in the following manner. The apparatus for playing a video wagering game may comprise, at least for example, a console, CPU, player controls, a wager acceptor and a video monitor attached to the console. The CPU contains memory able to display a game comprising:

displaying a hand of cards in response to a player placing a wager;

randomly selecting at least one card distinct from said hand of cards, said at least one card being randomly selected from an independent deck of cards at a time either before, during or after a play of the video wagering game (The at least one card must come from a virtual deck of cards, whether a standard or variant deck, that is a distinct virtual deck from the deck or decks used in the provision of the player's cards);

revealing said at least one card at a time before, during or after a game outcome is displayed;

displaying a game outcome;

establishing a rank (e.g., a poker ranked hand) or comparative value (e.g., counting value of cards as in blackjack, baccarat, 2½ or 21½, or other value counting games) for the player's hand, using any wild cards present in the player's hand (if there are no wild cards present in the player's hand, normal valuation will occur. Where value of hands is being determined, wild card values may be restricted. If wild cards were given unlimited values in Blackjack, for example, every hand with a wild card would be a Twenty-One. The limits could include specific values such as 1, 2 or 3; 3, 4 or 5; or only tens and the face value, for example); and awarding the player a payout for attaining a hand of at least a predetermined rank (e.g., a pair, two pairs, three-of-a-kind, straight, flush, etc.) or at least a value better than a dealer's hand (e.g., 19 beating a count of dealer's 18; players 20 beating a dealer's 19½ in 2½ or 21½, etc., the award being made whether or not a wild card is present in the player's hand.

FIG. 1 shows a video game apparatus 20 comprising a cabinet 30 with a video display screen 32 and an upper control panel 34. The upper control panel 34 is shown with a coin slot 36, but a currency slot or credit card slot may also be used, as well as a key pad for insertion of debit, credit or charge information. Also shown on the upper control panel 34 are control buttons 38, 40 and 42 which are here proposed as a single unit wager button 38, a maximum wager button 40 and a collect button 42. The video game apparatus 20 also is provided with a lower control panel 44. This lower control panel 44 is, for example, provided with a deal/draw button 46 and five separate hold/discard buttons 48. A coin outlet or coin tray 52 is also provided. On the video display screen 32 are shown images of the player's hand 54 with the five individual hand cards 58 shown in the player's hand 54. A separate image area 56 is provided for the display of the randomly selected wild card. A special deck-cutting feature with cut locator buttons 60 and 62 is shown on the lower control panel 44. An additional separate image area 57 is provided which provides a visual indication of a deck 64 and a cutting line 66. As locator buttons 60 and 62 are manipulated, cutting line 66 moves vertically in a direction indicated by arrow 64, or in an opposite direction simulating the cutting of cards.

Screen 32 contains a player-hand area 54 which displays five cards and a wild-card area 56 which at some point in time during the play of the game displays one card that determines the wild card.

The electronic circuit of the apparatus includes a CPU (Central Processing Unit) which may be connected to a clock circuit, a memory, an interface circuit, a video-display circuit, a coin-hopper circuit, and/or a data-storage circuit. The memory may be composed of a Read-And-Write Memory (RAM) and a Read-Only-Memory (ROM). RAM stores the game's variables and may have a battery back up. Thus, when the card-game apparatus is disconnected from its main power supply, the data stored in RAM is preserved for approximately ten years. ROM may contain information such as image patterns (memory bit maps) for the playing cards as well as the operating instructions for the CPU. An interface circuit could incorporate a sound generator and key activators, including single-bet button 38, maximum-bet button 40, collect button 42, deal/draw button 46, and hold/cancel buttons 48. A light circuit may be designed to illuminate those key activators ready to accept input data, which light circuit would be controlled by a drive circuit. Since the CPU may be a single-task processor, a buffer, which stores activator-key input information, may be placed before an input/output port of the CPU. A drive circuit is provided which is electronically linked to a sound generator, which signals to acknowledge activation of buttons or an occurrence of a win.

A video-display circuit might include the screen 32 (e.g., a cathode ray tube) having a video circuit, electronically connected to a cathode-ray-tube controller. As the cathode ray controller reads out an image pattern (memory bit map) for a playing card from ROM to RAM, it converts this data to a serial data format and may send it to a video circuit. Based on the video signals generated by circuitry, a predetermined image appears on the screen 32. A coin-hopper circuit would incorporate an electromechanical coin hopper, which may be controlled by a drive circuit. This circuit governs such functions as credit detection (tracking of cumulative player winnings), lock out (shut down of the game apparatus in case the jackpot is too large to be paid by the machine), and coin release. CPU receives data from the hopper through an input-output port via a buffer. Hopper must be able to store coins and make payoffs accurately and is always monitored by the CPU.

A data-storage circuit may comprise a disk drive, connected to an input-output port of the CPU through a buffer. A disk drive may controlled by a drive circuit and would store such statistics as number of rounds played, winnings amounts, percentage of hold in favor of the casino, and other game information. A management key (not shown) may be used by authorized personnel to display the aforementioned data or to obtain printouts through hard-copy devices (also not shown). Other hardware and parts of the above described card-game apparatus are similar to those used in existing video poker machines. Standard components include coin hoppers, coin acceptors, IBM-compatible computers, video-display screens, and VGA graphic-display cards.

Figure 2:
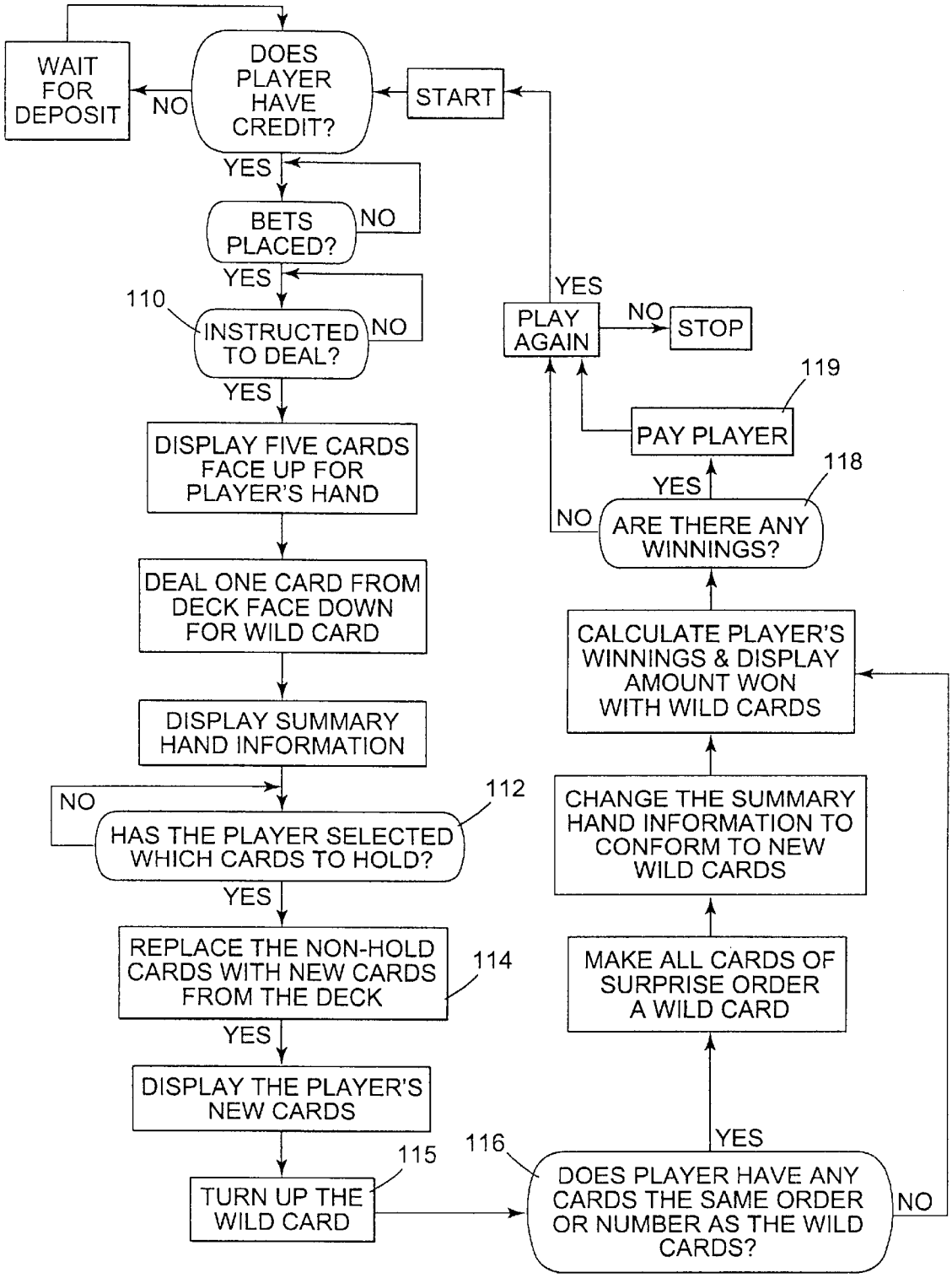
FIG. 2 is a flow chart which illustrates a sequence of logical operations performed by the central processing unit of the video card-game apparatus of FIG. 1 for draw poker with a randomly-determined wild card from a separate deck.

FIG. 2 shows a flow chart which illustrates the sequence of logical operations performed by a CPU in the play of a five card draw-type poker game enhanced by the incorporation of a randomly selected wild card of the present invention. The implementation of the game feature with other poker-type games, such as Let-It-Ride (Registered Trademark of Shuffle Master gaming, Inc.) or Caribbean Stud® poker or the like is contemplated. The description below refers to the major steps of the flow chart, cited parenthetically. To start the game, the player inserts the proper number of coins or tokens into coin inlet 36 or if credits are available, enters the number of credits to be wagered on bet buttons 38 and 40. The player then chooses the amount to wager either by repeatedly pressing the single-bet button 38 or by pressing the maximum-bet button 40 once to bet one or more coins, up to the wager limit. To receive an initial player's hand of, for example, the five cards initially dealt in five-card-draw poker, which cards normally would appear face up in player-hand area 54, the player activates deal/draw button 46. The cards dealt are randomly selected from a first master set of cards, preferably consisting of a single 52 card deck of cards, or from a number of intermixed decks. At some point in the play of the game, either before the player's hand is displayed, simultaneously as the player's hand is displayed, after the player's hand is displayed, before cards are discarded, after cards are discarded and before drawing replacement cards, or after cards are discarded and after replacement cards are drawn, a single card appears (normally face down, but alternatively, at any time, face up in wild-card area 56. The single card is randomly selected from a second and separate deck of cards. The CPU randomly generates the player's cards from a first master set or "pool" comprising a single deck or even multiple decks, either mixed together or each deck dedicated to a single player card position, a deck usually corresponding to a deck of 52 standard playing cards, which is usually ranked from low to high in the order of 2, 3, 4, 5, 6, 7, 8, 9, 10, Jack, Queen, King, and Ace. Preferably, the hand is dealt from a single 52 card deck of cards. The cards in player-hand area 54 are either displayed in random fashion, automatically arranged in order of increasing rank or the player may rearrange the cards as desired. Appropriate guiding means or symbols may be illuminated to help the player identify ranked hands such as One Pair, Two Pair, Three of a Kind, etc.

Following the rules of draw poker, the player may attempt to improve the ranking of the five-card hand by discarding up to five cards and replacing them with new cards (i.e., a modified hand) randomly generated by CPU from the same master set (the deck, mixed deck, or individual decks for each player's card position) as the originally dealt cards. The player identifies the cards he or she wants to retain by activating buttons 48 which correspond to those cards (Step 112). The player may reverse this decision by activating the same buttons 48 for a second time, thus releasing the hold on the previously identified cards. To discard the unwanted cards, the player presses button 46 (Step 114). The discarded cards are automatically replaced with the same number of new cards.

At some point in the play of the game, here shown for exemplary purposes as simultaneously dealt with the last replacement card in draw poker, when the last hold button is pressed in draw poker, when the last card is displayed in stud poker, or at the end of the game in any type of poker, the single card located in area 56 is displayed face up. The face value, rank or face value and rank of the card displayed in area 56 determines the wild card or cards in this round of the game. Preferably all cards in the five-card hand (or more cards) which have the same face value as the card displayed in area 56 are designated wild, i.e., they may possess any specified value. The CPU evaluates the ranking of the five-card hand and, when wild cards are present, assigns to the hand the highest allowable rank made possible by the wild cards (Step 116). The card displayed in area 56 is not actually included in the player's five-card-hand for determining a ranking; that is, it does actually not become a part of the hand. However, since it is generated from a distinct deck of standard playing cards, a number of advantages are present which were not possible when the wild card is drawn from the master set of cards. Although the deck used to draw the wild card may be a standard 52-card deck, it may be a special deck such as a Spanish Twenty-One deck.

There are a number of advantages that may be found in the play of this game.

Advantage #1: The game allows for a single card to be designated as special.

When a single card is selected as the designator for all wild cards in a specific game, a pay table can designate that randomly specified card as special. This is only possible when the designator card is selected from an external deck. If the card were selected from the deck in play, there would be no feasible way to specify that card as wild without removing it from play.

For example, if one were to try to construct the pay as designated above in "advantage #2" it would not be possible for the King of Spades to appear in a player's hand. Thus, that specific card could not be used as a qualifier for a hand comprised of Kings and Spades.

Advantage #2: The method allows for the wild card selection without affecting the base game.

Assume there is a five-card stud game, which includes a side game. In this side game, the player may make a separate wager that pays according to the number of cards in his stud hand that match the suit and/or rank of an externally selected wild card. If the wild card is selected from an external deck, the base game will not be affected by the wild card selection for the side game.

This example illustrates that the method of the present invention need not be practiced as an underlying game. Wild cards can be used to resolve a base game, one or more side games, or combinations of the above.

Advantage #3: The method allows for differentiation in hit frequency based upon the selected wild card.

If, in a game, the selected wild card is of a low value, such as a 2 or 3, that game has a higher expected value than if the selected wild card is of a high value.

| | Ways | p(x) |
|---|---|---|
| Example A: King is Wild | | |
| Royal Flush (no wilds) | 4 | 0.0000015 |
| Wild Royal Flush | 276 | 0.0001062 |
| TOTAL | 280 | 0.00010774 |
| Example B: Two is Wild | | |
| Royal Flush (no wilds) | 4 | 0.0000015 |
| Wild Royal Flush | 500 | 0.0001924 |
| TOTAL | 504 | 0.00019392 |

The player's winnings are determined on the basis of the final five-card-hand ranking and jackpot amounts may be calculated according to any pay table or pay schedule, for example a pay schedule such as the following:

| Hand Rank | Bonus Payment |
|---|---|
| Royal Flush (without wild cards) | 500 × BET |
| Five of a Kind | 250 × BET |
| Royal Flush (with wild cards) | 200 × BET |
| Straight Flush | 25 × BET |
| Four of a Kind | 5 × BET |
| Full House | 4 × BET |
| Flush | 4 × BET |

-continued

| Hand Rank | Bonus Payment |
|---|---|
| Straight | 3 × BET |
| Three of a Kind | 2 × BET |
| Two Pair | 2 × BET |
| One Pair (Jacks or Better) | 1 × BET |

Since the payouts will vary depending upon the rank and/or suit of the wild card selected, it would be advantageous to provide an electronic display of the pay table which reveals payouts for the particular wild card selected. For example, the payout for a Royal Flush formed with a King that is wild pays more than a Royal Flush formed with a 2 that is the wild card, based on the probability of occurrence of the hands. Advantageously, a changeable display could display the pay table which corresponds to the selected wild card and could conceal payouts for wild cards which are not in play. This feature is likely to simplify the process of paying bonuses and is also likely to eliminate player or dealer confusion as to the payouts.

To collect the winnings, the player presses collect button 42 (Step 118). The coins are dispensed through coin outlet 52.

The card game is attractive to players because the wild cards make it possible to win large jackpots on small wagers and hands with high ranks may be more frequently attained. Moreover, since the wild cards are preferably declared only after the player has a chance to alter his or her hand, an exciting element of surprise is introduced into the game. Also, the pay schedule may be fixed throughout the game and no additional wagers are required during the round.

Figure 3:
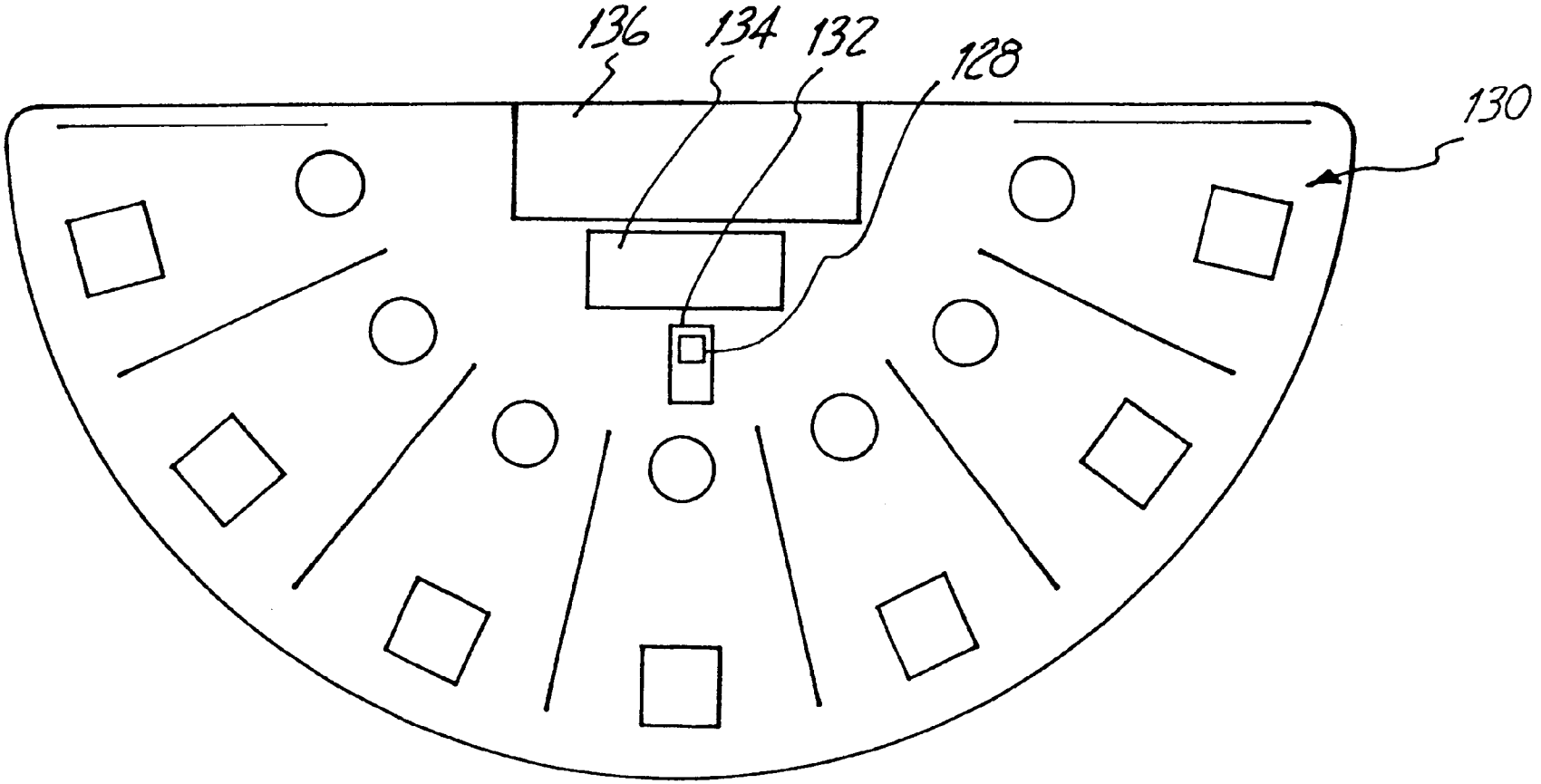
FIG. 3 is an overhead view of a playing area of a card table according to the invention.

Referring to FIG. 3, a gaming table 130 is provided. The gaming table is equipped with a video display 132 which displays a video representation of a common wild card 128 drawn from a separate deck of cards. A second video display 134 is located forward of the chip rack 136 and is used to display the electronically generated pay table corresponding to the selected wild card. A game computer (not shown) is provided with memory and a central processing unit. The CPU is programmed to randomly select a card from a separate deck. The computer sends a signal to the video output display, which in Turk displays the wild card in display area 132.

Figure 4:
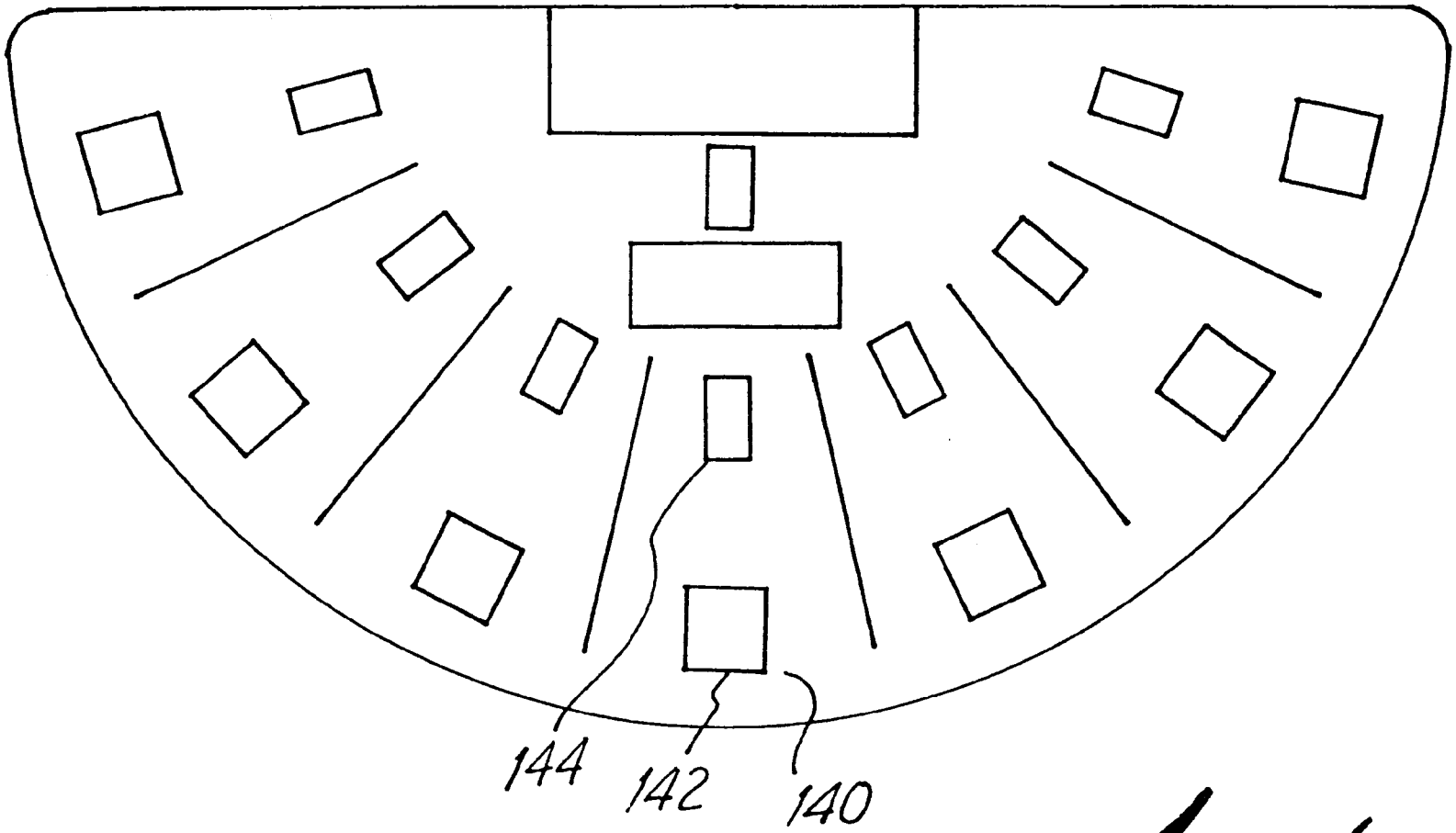
FIG. 4 is an overhead view of a second playing area of a card table according to the invention.

A plain view of a playing area according to a second table-game version of the present invention is shown in FIG. 4. In the table version of the card game, a master deck of 52 standard playing cards which are ranked from low to high in the order of 2, 3, 4, 5, 6, 7, 8, 9, 10, Jack, Queen, King, and Ace is utilized along with a playing table (not shown). The playing table surface contains a plurality of player stations, such as station 140. Each player station includes a player-hand area 142 and a single-card area 144. After making a wager, each player is dealt a hand of five cards from a first master deck which is placed in area 142. The player also receives a solitary card from a separate deck which is dealt face down in area 144.

The player may attempt to improve the ranking of the five-card hand by discarding up to five cards and replacing them with new cards randomly dealt from the master deck. At some time during the play of the game, herein for exemplary purposes only after the player rearranges the five-card hand, the solitary card located in area 144 is turned face up and its face value determines the wild cards in this round of the game. That solitary card is provided preferably from a shuffled deck that is distinct from the deck in which the cards used for the construction of a player's hand are chosen. The distinct deck may be a physical deck (of one or more standard decks), an artificial deck (e.g., thirteen cards, one each of, 3, 4, 5, 6, 7, 8, 9, 10, Jack, Queen, King, and Ace), a special deck such as a Spanish 21 or Canasta deck or a virtual deck with a video display screen in the area of the gaming table (e.g., near the table, on the edge of the table, or mounted on or in the gaming table). All cards in the five-card hand which have the same face value as the card displayed in area 124 are designated wild, i.e., they may possess any specified value which most improves the ranking of the five-card hand. If the five-card hand contains any wild cards, its raking is reevaluated by the dealer. The ranking of the five-card hand is then compared to the rankings of other players's hands in order to determine which player or players has won the wager.

Although the game has been described in the form of several specific embodiments, its arrangements and configurations are given only as examples, and many other variations of the game are possible. For example, in one version of the game only number cards, and not face cards such as Jacks, Queens, or Kings, may be wild. Moreover, the game may be structured in such a manner that only four wild cards are possible in the five-card hand. This may be achieved by generating the indicator wild card from a different pool of elements than the actual playing cards. The game may be played as a table version as well as a computer version. The card-game apparatus may utilize a touch-sensitive screen, a mouse, or a light pen in order to manipulate the card images. Other data-storage media, such as magnetic tape and paper tape, may be employed with the card-game apparatus. Furthermore, paper-ticket printers may be utilized instead of coin hoppers. Different types of guiding symbols may be used in the video version of the game in order to help the player evaluate his or her hand. Therefore, the scope of the invention should be determined, not by the examples given, but by the appended claims and their legal equivalents.

Some repeated mention has been made with regard to the flexibility allowed in the timing of the provision and/or display of the wild card. This action can of course significantly vary motivation to play a hand or alter a hand. For example, providing and displaying the wild card before the player discards can significantly change a player's strategy. For example, a player with a hand of ACE of Hearts, KING of Hearts, JACK of Hearts, TEN of Hearts and Three of diamonds would in all normal cases discard the Three of Diamonds. If the Wild Card were exposed prior to discarding and was a Three, the player would not discard a Three. Similarly, if a player's hand were ACE, KING, QUEEN of a single suit and a pair of deuces, most player's will discard the deuces to attempt to get either a Royal Flush, a Flush, a Straight or a pair higher than a pair of Jacks. If the Wild Card exposed before discarding were a two, playing strategy would be altered. More importantly, with a game such as Let It Ride® Stud Poker (registered trademark of Shuffle Master Gaming, Inc.), cards involved in the construction of the hand are displayed at different times in the play of the game. The significance of the time when the Wild Card is displayed therefore becomes much more influential on the play of the game and the strategy.

In the play of Let It Ride® Stud Poker (registered trademark of Shuffle Master Gaming, Inc.), the player is dealt three cards face down (which the player may view at any time) and the two common cards are dealt face down (which are initially withheld from view). A bet of equal value appears adjacent to each of the player's three cards. After viewing all three of the player's cards, the player may elect to withdraw the first of the three wagered tokens or allow all three wagers to continue in play, depending on the player's view of the likelihood of the three cards contributing to a winning hand (e.g., at least a pair of nine's). If the single displayed card that establishes the Wild Card were displayed before the election to retain or withdraw the first bet, the player would be in a much better position to establish the value of the hand. If the hand is a natural (e.g., with at least a pair of nine's), with or without a wild card, the player will always leave all bets on the table. If the player determines that at least one card is a wild card (one card in the player's hand matching the display card), the player is likely to remain in for all bets, even if no other card in the player's hand is at least a nine, as it is likely that at least one of the common cards will equal a nine or more or match one of the player's cards.

In Let It Ride® (registered trademark of Shuffle Master Gaming, Inc.) Poker, it would also be advantageous to have the display card that determines the Wild Card turned face-up after the first election to retain or withdraw the first bet amount is made, but the influence is not quite as great. After the election to retain or withdraw has been made, and after at least one common card has been revealed, the display card may then be revealed. This still improves the relative ability of a player to determine that there is a likelihood or assurance of a winning hand, but the impact is slightly lessened. That order of event is therefore also a likely scenario. The format that is most advantageous to the house is to reveal the display card only after both of the dealer's hole cards are revealed.

The wild card may be used in a wide variety of games as indicated herein. The wild card may also be used in games where payouts are determined by hand evaluations other than just ranks of hands, as in draw or stud poker games. Fore example, payouts may be determined on the basis of the value or numerical totals of hands, such as Blackjack, 7½ and 21½, Over/Under, and the like.

The method of the present invention is suitable for a wide variety of card games, including games in which players play against the dealer, (Caribbean Stud® poker, Pai Gow poker, Three Card poker™, and Blackjack), games in which the players compete against each other (i.e., poker), and for resolving side bet games (e.g., Pairs Plus bets in three card poker, the bonus bet in Let It Ride®, and a bonus bet in Caribbean Stud® poker). For a side bet game, the wild card can be used to score a base game, the side bet or both. When the method is used to score a side bet, the game can pay a proportional or progressive payout for combinations of the above.

What is claimed:

1. An apparatus for playing a casino table game with physical cards and a video display for wild cards comprising, a plurality of physical cards, positions for individual players' physical card, positions for individual players' wagers, and a video display area selected from the group consisting of a common display area and individual display areas for each player.

2. A video gaming apparatus for playing a card game with a video display of a player's hand and a wild card comprising:

a display area for video playing cards to a player to form an original hand after the player has made a wager on a card game being played with that original hand;

software implementing a separate virtual deck of playing cards to deal at least one card that is a video display card;

c) and after play of the game, showing the value of the at least one card that is a video display card, the at least one card that is a video display card establishing a fact that the cards in the player's hand has a predetermined relationship to the at least one card that is a video display card are Wild Cards for the purpose of establishing a rank or value for the player's hand; and d) the apparatus having a payout system for paying the player for:

I) attaining a hand of at least a predetermined rank; or

II having a hand with a value higher than the value of a dealer's hand;

said rank or value being determined with or without the presence of Wild Cards.

3. The apparatus of claim 1 wherein the card game comprises Let-It-Ride® poker.

4. The video gaming apparatus of claim 2 wherein the card game comprises Let-It-Ride® poker.

5. The apparatus of claim 3 wherein Let-It-Ride® poker is played by software implementing a separate virtual deck of playing cards to deal at least one card that is a video display card to all players, the single card being selected from a set of cards that are not used in play of the Let-It-Ride® poker, ranked values of players'hands being read in view of the presence or absence of Wild Cards in individual hands based upon matching the display card.

6. The apparatus of claim 4 wherein Let-It-Ride® poker is played by software implementing a separate virtual deck of playing cards to deal at least one card that is a video display card to all players, the single card being selected from a set of cards that are not used in play of the Let-It-Ride® poker, ranked values of players'hands being read in view of the presence or absence of Wild Cards in individual hands based upon matching the display card.

7. The video gaming apparatus of claim 2 wherein step c) is performed after a player has made an election on retaining or withdrawing a first bet means.

8. The video gaming apparatus of claim 4 wherein step c) is performed after a player has made an election on retaining or withdrawing a first bet means.

9. The video gaming apparatus of claim 6 wherein step c) is performed after a player has made an election on retaining or withdrawing a first bet means.

10. The video gaming apparatus of claim 2 further enabling the steps of discarding cards from the original hand and dealing replacement cards wherein step c) is performed before a player has elected to discard cards.

11. The video gaming apparatus of claim 2 wherein step c) is performed after a player has elected to exchange specific cards.

12. The video gaming apparatus of claim 2 wherein step c) is performed after a player has received replacement cards in exchange for discarded cards.

13. The apparatus of claim 1 wherein a standard deck of playing cards is used at a live casino table, to deal the cards.

14. The apparatus of claim 1 wherein a virtual deck of cards is used with a video format apparatus to deal the cards.

15. The apparatus of claim 1 wherein the physical table game with cards comprises a poker-type game of:

a) dealing a number of playing cards to a player to form an original hand, the player having made a wager on a poker game being played with that original hand;

b) allowing the player to discard cards from the original hand;

c) dealing a player replacement cards to bring the player's hand up to the number of cards used to play the game of poker;

d) from a separate deck of playing cards, dealing at least one card that is a display card;

e) at any time during play of the game, showing the value of the display card, the display card establishing a fact that cards of predetermined relationship to the display card are Wild Cards for the purpose of establishing a rank for the player's hand; and f) paying the player for attaining a hand of at least a predetermined rank with or without the presence of Wild Cards.

16. The apparatus of claim 1 in which individual hands are provided to each player and wherein each original hand is dealt from a master set of cards and said master set is a standard 52 card deck of cards.

17. The apparatus of claim 1 in which individual hands are provided to each player and wherein each original hand is dealt from a master set of cards and said master set comprises a plurality of standard 52 card decks of cards, and the cards are randomly mixed within said master set.

18. The apparatus of claim 1 wherein the physical casino table game comprises draw poker.

19. The apparatus of claim 1 wherein the physical casino table game comprises a casino card game that is selected from the group consisting of draw poker, stud poker, Caribbean Stud® poker, Texas Hold-Em poker, Blackjack, Pai Gow poker, 3 Card Poker™, Baccarat, Mini Baccarat and Triple Play poker.

20. The apparatus of claim 1 wherein in the play of the physical casino table game players are paid for the highest hand ranking when a wild card is present in the band.

21. The video gaming apparatus of claim 2 wherein in the play of the physical casino table game players are paid for the highest hand ranking when a wild card is present in the hand.

22. The video gaming apparatus of claim 2 wherein the display card is a visual representation of a card displayed on a video monitor, and wherein the separate deck is a computer generated deck of cards.

23. The apparatus of claim 15 wherein the predetermined relationship is a) rank, b) suit or c) rank and suit.

24. The video gaming apparatus of claim 2 wherein the step of showing the value of the display card is performed after the player had received all cards for a final hand.

25. The video gaming apparatus of claim 4 wherein the step of showing the value of the display card is performed after the player had received all cards for a final hand.

26. The video gaming apparatus of claim 6 wherein the step of showing the value of the display card is performed after the player had received all cards for a final hand.

27. The video gaming apparatus of claim 2 wherein paying the player in step d) occurs with both beating the dealer's hand and having a rank of at least a predetermined rank.

28. The video gaming apparatus of claim 2 wherein paying the player occurs with both beating the dealer's hand and having a rank of at least a predetermined rank.

29. The video gaming apparatus of claim 2 wherein paying the player in step f) occurs with both beating the dealer's hand and having a rank of at least a predetermined rank.

30. The apparatus of claim 1 wherein the video display area provides a video display card that is a common card used by all players.

31. The method of claim 1 wherein the video display area provides a video display card in a manner selected from the group consisting of a common display area and individual display areas for each player.

* * * * *

UNITED STATES PATENT AND TRADEMARK OFFICE

CERTIFICATE OF CORRECTION

PATENT NO. : 6,299,170 B1
DATED : October 9, 2001
INVENTOR(S) : Mark L. Yoseloff It is certified that error appears in the above-identified patent and that said Letters Patent is hereby corrected as shown below:

Title page,
Item [76], Inventor, insert the following: -- [73] Assignee: Shuffle Master, Inc, Eden Prairie, MN --.

Signed and Sealed this

Sixteenth Day of July, 2002

*Attest:*

*Attesting Officer*

JAMES E. ROGAN
*Director of the United States Patent and Trademark Office*